US007030723B2

(12) United States Patent
Bărnklau et al.

(10) Patent No.: US 7,030,723 B2
(45) Date of Patent: Apr. 18, 2006

(54) ELECTROMAGNETIC SWITCHING DEVICE

(75) Inventors: Karl-Hans Bărnklau, Weiden (DE); Johann Drexler, Schwandorf (DE); Peter Hartinger, Bodenwoehr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/676,130

(22) Filed: Oct. 2, 2003

(65) Prior Publication Data

US 2004/0119567 A1 Jun. 24, 2004

(30) Foreign Application Priority Data

Oct. 2, 2002 (DE) ..... 102 46 092

(51) Int. Cl.
*H01H 67/02* (2006.01)

(52) U.S. Cl. ..... 335/132; 335/167

(58) Field of Classification Search ..... 335/132.202, 335/167–176, 132, 202; 200/42.12–15, 44.14–44.15
See application file for complete search history.

(56) References Cited

U.S. PATENT DOCUMENTS 5,844,186 A * 12/1998 Meriwether ..... 200/50.02
6,559,745 B1 * 5/2003 Yamagata et al. ..... 335/132

FOREIGN PATENT DOCUMENTS

DE 19716380 4/1997
DE 102 14 890 C1 5/2003

* cited by examiner

*Primary Examiner*—Lincoln Donovan
(74) *Attorney, Agent, or Firm*—Harness, Dickey & Pierce, P.L.C.

(57) ABSTRACT

An electromagnetic switching device includes an electromagnetic drive apparatus and has a moving contact element which can be operated by this drive apparatus. The moving contact element can be switched between a bridging position, which connects a pair of stationary contacts, and a disconnected position, which disconnects the stationary contacts. The electromagnetic switching device also has an actuating apparatus having an actuating element which interacts with the moving contact element and can be moved between an operating position and a safe position. In the operating position, the moving contact element can be switched by the electromagnetic drive apparatus between the bridging position and the disconnected position. Further, by movement of the actuating element to the safe position, the moving contact element can be blocked from moving from the bridging position to the disconnected position, and can be blocked in the disconnected position.

19 Claims, 3 Drawing Sheets

ELECTROMAGNETIC SWITCHING DEVICE

The present application hereby claims priority under 35 U.S.C. §119 on German patent application number DE 102 46 092.2 filed Oct. 2, 2002, the entire contents of which are hereby incorporated herein by reference.

FIELD OF THE INVENTION

The invention generally relates to an electromagnetic switching device. In particular, it relates to a contactor, having an electromagnetic drive apparatus which operates a moving contact element. The moving contact element may in this case assume a bridging position in which a pair of stationary contacts are connected, and a disconnected position, in which the stationary contacts are disconnected.

BACKGROUND OF THE INVENTION

A switching device is disclosed, for example, in DE 197 16 380 C1.

A contactor is frequently used as an electrical switch which can be operated remotely. In addition to the contactor, the electrical systems use a main switch or switching device with disconnector characteristics to ensure that the system is not live, particularly when work is being carried out on the electrical system. Requirements for load-break switches and disconnectors are described, for example, in IEC Standard 60947-3 and in EN Standard 60947. In order to comply in particular with the requirements in these Standards, a separate switch is provided, in addition to the contactor, in the electrical system.

SUMMARY OF THE INVENTION

An embodiment of the invention includes an object of allowing safe disconnection of an electrical system with little hardware complexity.

According to an embodiment of the invention, an object may be achieved by an electromagnetic switching device. On the one hand, the switching device has an electromagnetic drive apparatus, and on the other hand it has an actuating apparatus which can be operated manually.

A moving contact element can be operated by the electromagnetic drive apparatus and can assume a bridging position and a disconnected position. In this case, a pair of stationary contacts can be connected to one another and can be disconnected from one another. The actuating apparatus which can be operated manually can be switched between an operating position and a safe position. In this case, an actuating element that interacts with the moving contact element can be moved between the operating position and the safe position.

In the operating position, the moving contact element can be switched by the electromagnetic drive apparatus between the bridging position and the disconnected position. Thus, the switching options for the electromagnetic drive apparatus and for the moving contact element are not influenced when they are in the operating position, by the actuating apparatus which can be operated manually. On the other hand, the moving contact element is blocked in the disconnected position when in the safe position. In this case, on the one hand it is possible to move the actuating element of the actuating apparatus which can be operated manually from the operating position to the safe position when the moving contact element is already in the disconnected position. In this case, operation of the actuating element which can be operated manually does not change the switching position of the moving contact element, but just blocks the moving contact element in its switching position.

On the other hand, it is also possible when the moving contact element is in the bridging position for the actuating element of the actuating apparatus which can be operated manually to be moved from the operating position to the safe position. In this case, the moving of the actuating element which can be operated manually moves the moving contact element from the bridging position to the disconnected position. Manual operation rather than electromagnetic operation thus takes place when switching from the operating position to the safe position.

In addition to the safe position and to the operating position, the actuating element of the actuating apparatus which can be operated manually is suitable, according to one preferred development, for blocking the moving contact element in the bridging position when it is in an on position. Thus, analogously to the safe position, the electromagnetic drive apparatus is also rendered inoperative in the on position, in which case, in contrast to this, the stationary contacts are still bridged by the moving contact element. It is also possible to move the moving contact element from the disconnected position to the bridging position, against the influence of the electromagnetic drive apparatus.

When the actuating element of the actuating apparatus which can be operated manually is in the safe position, then there is no point in supplying current to the electromagnetic drive apparatus. A current supply such as this could even cause damage to the electromagnetic switching device.

In order to safely prevent this, the electromagnetic switching device preferably has an auxiliary switch which, when coupled to the actuating apparatus which can be operated manually, disconnects the electromagnetic drive apparatus from its power supply when the actuating element is in the safe position. The auxiliary switch preferably disconnects the power supply to the electromagnetic drive apparatus before the moving contact element is disconnected from the stationary contacts by way of the actuating apparatus which can be operated manually. This therefore allows easy operation of the actuating apparatus, which can be operated manually, without any risk of damage to the electromagnetic switching device. When the actuating element is in the on position, automatic disconnection of the electromagnetic drive apparatus from its power supply can also be provided in an analogous manner.

An advantageous geometry for transmitting mechanical power between the electromagnetic drive apparatus and the moving contact element, and between this and the actuating apparatus which can be operated manually, is achieved in a preferred manner by the electromagnetic drive apparatus, the moving contact element as well as the actuating element which can be operated manually being intersected by a common axis, in particular each being arranged essentially symmetrically with respect to this axis. The actuating element which can be operated manually, can preferably be moved linearly relative to the moving contact element. This allows mechanical power to be transmitted in a particularly effective manner between the actuating apparatus which can be operated manually and the moving contact element which can be operated optionally by this or by the electromagnetic drive apparatus.

An electromagnetic switching device design which is particularly convenient for installation can be achieved in a preferred manner by the switching device being formed from a basic appliance. It preferably includes the electromagnetic drive apparatus as well as the moving contact element and the stationary contacts on the one hand. It further includes the actuating apparatus which can be operated manually and is mechanically coupled to the basic appliance, on the other hand. The basic appliance preferably has all the functions of a contactor. Further, its physical design also preferably corresponds to that of a contactor. The actuating apparatus which can be operated manually is preferably permanently connected to the basic appliance in a manner which is physically relatively simple and is convenient for installation, by way of a latching connection which is intended to allow installation only once.

The actuating element of the actuating apparatus which can be operated manually is preferably operated by way of a rotary switch. Alternatively, other elements which can be operated manually, for example a rocker arm, can also be used. The rotary switch or the rocker arm can preferably be blocked at least in the safe position by way of a lock, for example a padlock or a lock which is integrated in the actuating apparatus.

An embodiment of the invention has the particular advantage that the functions of a contactor are integrated in a physically simple manner with those of a disconnector, load disconnector, fused load disconnector, circuit breaker with an isolating function or a similar device in a single electromagnetic switching device which can be operated manually.

BRIEF DESCRIPTION OF THE DRAWINGS

The present invention will become more fully understood from the detailed description of preferred embodiments given hereinbelow and the accompanying drawings, which are given by way of illustration only and thus are not limitative of the present invention, and wherein.

Parts which correspond to one another are provided with the same reference symbols in all the figures.

DETAILED DESCRIPTION OF THE PREFERRED EMBODIMENTS

Figure 1:
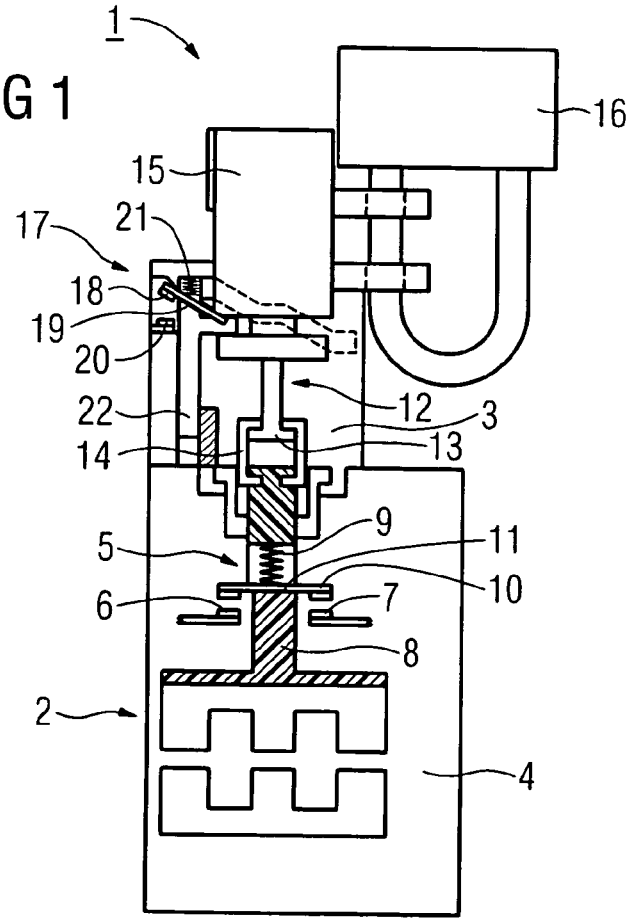
FIG. 1 shows an electromagnetic switching device with an actuating apparatus which can be operated manually, in the safe position, FIGS. 2*a,b* show a rotary switch for the switching device as shown in FIG. 1, in the safe position, FIGS. 3*a,b* show an auxiliary switch for the switching device as shown in FIG. 1.

FIG. 1 shows a schematic cross section of an electromagnetic switching device which is formed from a basic appliance 2 and an actuating apparatus 3 which is latched onto this basic appliance 2 and can be operated manually. The basic appliance 2 acts as a contactor and comprises an electromagnetic drive apparatus 4, a moving contact element 5 which can be operated by this contactor as well as a pair of stationary contacts 6, 7 which interact with it. The moving contact element 5 has a plunger 8 and a contact link 10 which is clamped within this by the use of a spring 9 and by which the contact can be made between the stationary contacts 6, 7. The spring 9 presses the contact link 10 against a stop surface 11 on the plunger 8, in which case the contact link 10 can be lifted slightly off the stop surface 11 when it is being used to bridge the stationary contacts 6, 7. The illustration shows the contact link 10 lifted off the stationary contacts 6, 7. The moving contact element 5 is in the disconnected position.

In contrast to the illustrated embodiment, the contact link 10 may also be in the form of a rocker arm. In this case, one of the stationary contacts 6, 7 is permanently connected to the contact link 10, for example by means of a hinged joint, or is identical to a part of the contact link 10, at least part of which can move. Electrical disconnection is in this case provided only on the respective other stationary contact 6, 7.

Figure 2A:
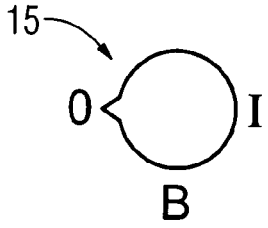
Figure 2B:
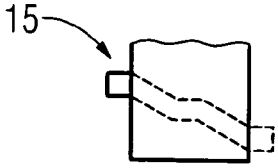

The actuating apparatus 3 which can be operated manually has an actuating element 12 which, for example, is in the form of a bolt and is mechanically coupled to the plunger 8. A broadened endpiece 13 on the side of the actuating element 12 which faces the basic appliance 2 in this case engages in a sleeve 14 (which is connected in a fixed manner to the plunger 8) and is thus positively connected to the moving contact element 5. The endpiece 13 can be moved through an actuating movement distance a in the sleeve 14. In the illustration, a rotary switch 15 is located above the sleeve 14, and is illustrated in the form of a plan view and in the form of a further schematic cross section, in the form of a detail, in FIGS. 2*a*, 2*b*. In the illustration shown in FIGS. 1, 2*a*, 2*b*, the actuating apparatus 3 which can be operated manually is located in the safe position. The rotary switch 15 is sent to the zero position, and the plunger 8 is pulled as far as possible upwards, that is to say away from the basic appliance 2. It is impossible to operate the plunger 8 by means of the electromagnetic drive apparatus 4, since the plunger 8 is blocked via the sleeve 14 and the actuating element 12. The rotary switch 15 is secured by means of a lock 16 in the form of a padlock.

The electromagnetic drive apparatus 4, the plunger 8, the contact link 10, the sleeve 14 as well as the actuating element 12 and the rotary switch 15 are intersected by a common axis A and are designed such that their cross sections are essentially symmetrical with respect to this axis A. Mechanical power is transmitted between the plunger 8 and the contact link 10, as well as between this and the electromagnetic drive apparatus 4, essentially linearly along the axis A.

Figure 3A:
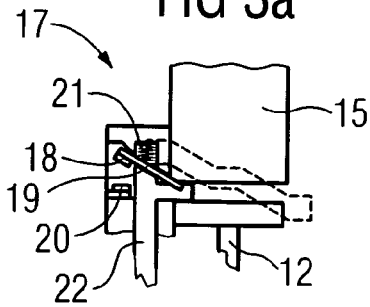
Figure 3B:
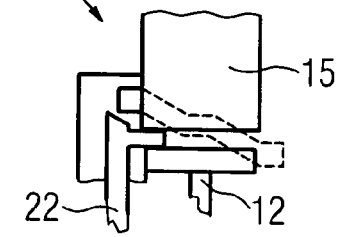

In order to prevent current from being supplied to the electromagnetic drive apparatus 4, an auxiliary switch 17 is provided, having a switching link 19 that has a moving contact 18, a stationary contact 20 and a compression spring 21 which applies force to the switching link 19. In the illustrated safe position, in which the stationary contacts 6, 7 are disconnected, the moving contact 18 is lifted off the stationary contact 20 against the spring force of the compression spring 21 by way of a driver 22 which is connected to the actuating element 12 and acts on the switching link 19. The electrical connection between the auxiliary switch 17 and the electromagnetic drive apparatus 4 is not illustrated. The operation of the auxiliary switch 17 can be seen in particular from FIGS. 3*a*, 3*b*, although, for the sake of clarity, FIG. 3*b* does not show the contacts 18, 20, the switching link 19 or the compression spring 21.

Figure 5A:
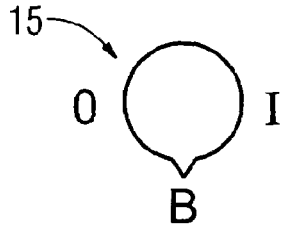
Figure 5B:
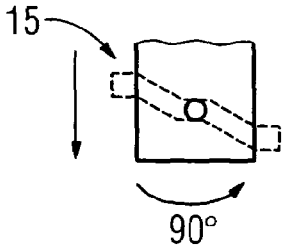
Figure 4:
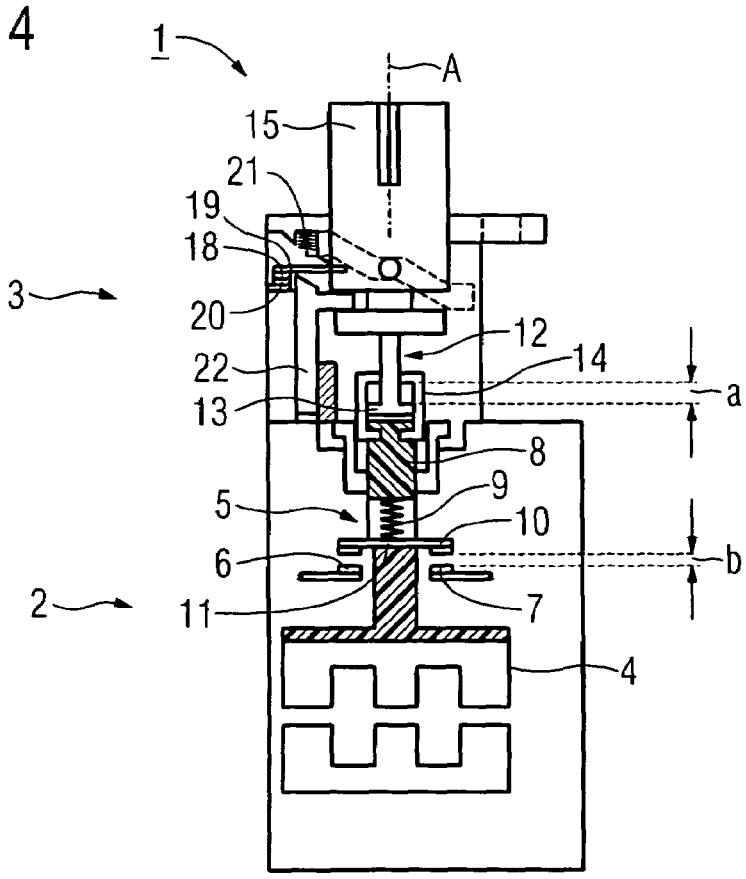
FIG. 4 shows the electromagnetic switching device with an actuating apparatus that can be operated manually, in the operating position, FIGS. 5*a,b* show the rotary switch in the operating position.

FIGS. 4, 5*a*, 5*b* show the electrical switching device 1 and the rotary switch 15 in the operating position. The auxiliary switch 17 is in this case closed, that is to say the electromagnetic drive apparatus 4 can be operated electrically. In comparison to the safe position illustrated in FIG. 1, the actuating element 12 which can be operated manually has been lowered through an actuating movement distance a, that is to say it has been moved in the direction of the basic appliance 2. The actuating movement distance a is in this case the maximum travel of the plunger 8 through which its endpiece 13 can be moved within the sleeve 14 when the sleeve 14 is stationary.

The position of the sleeve 14 in the operating position as shown in FIG. 2 is identical to the position of the sleeve 14 in the safe position as shown in FIG. 1. However, in the operating position, it is possible for the plunger 8 to move, and hence also for the contact link 10 to move in the direction of the electromagnetic drive apparatus 4. The plate movement distance b through which the contact link 10 is lifted off the stationary contacts 6, 7 in the disconnected position as illustrated in FIGS. 1 and 2 is less than the actuating movement distance a. The plunger 8 including the contact link 10 can thus be switched by means of the electromagnetic drive apparatus 4, as in the case of a conventional contactor, when the actuating apparatus 2 which can be operated manually is in the operating position.

Figure 7A:
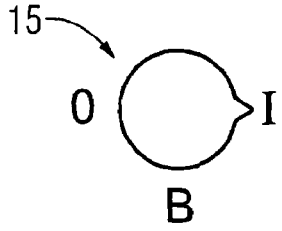
Figure 7B:
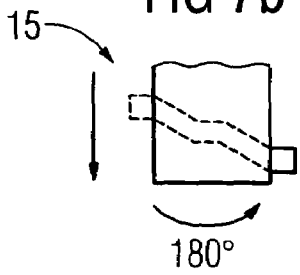
Figure 6:
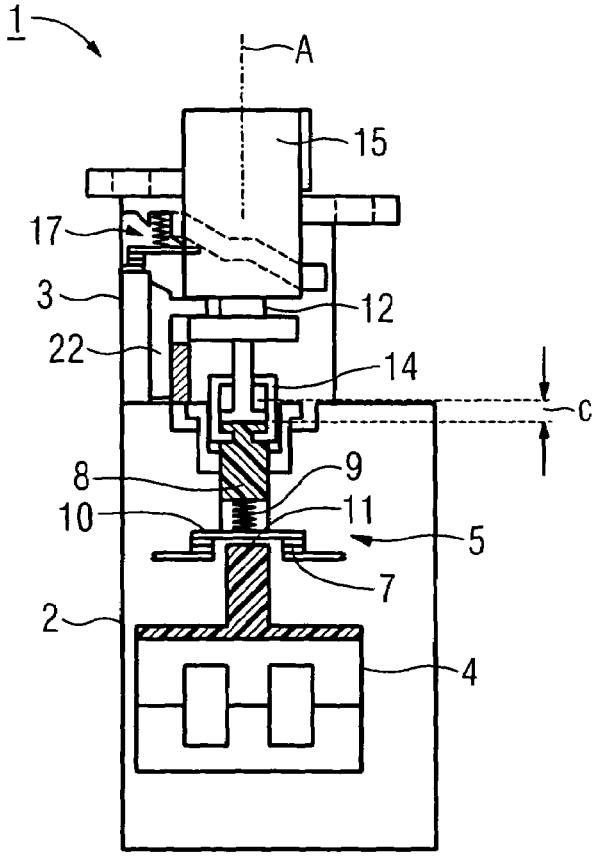
FIG. 6 shows the electromagnetic switching device with an actuating apparatus which can be operated manually, in the on position, and FIGS. 7*a,b* show the rotary switch in the on position.

FIGS. 6 and 7*a*, 7*b* show the electrical switching device 1 with the actuating apparatus 3 which can be operated manually in the on position. When the rotary switch 15 is switched from the safe position "0" (FIGS. 2*a*, 2*b*) via the operating position "B" (FIGS. 5*a*, 5*b*) to the on position "I" (FIGS. 7*a*, 7*b*), the actuating element 12 is in each case moved through an additional movement distance c in the direction of the basic appliance 2, in comparison to the operating position (FIG. 4), in the illustrated on position. The contact link 10 is blocked in the bridging position, which connects the stationary contacts 6, 7. In this case, the contact link 10 is lifted slightly off the stop surface 11, so that the spring 9 is somewhat compressed in comparison to the disconnected position (FIGS. 1, 4), in which the contacts 6, 7 are disconnected.

In the illustrated exemplary embodiment, the auxiliary switch 17 is closed when the actuating apparatus 3 which can be operated manually is in the on position. However, alternatively, the auxiliary switch 17 could also be opened automatically in the on position, or a further switch which is not illustrated but is connected in series with the auxiliary switch 17 could be opened, so that the electromagnetic drive apparatus 4 cannot be operated electrically even when the actuating apparatus 3 which can be operated manually is in the on position.

If the stationary contacts 6, 7 are slightly welded to the contact link 10, then the slight welding, as is provided for Type 2 Coordination in IEC Standard 60947-4-1 is interrupted. If, on the other hand, the contact link 10 is firmly welded to the stationary contacts 6, 7, then the actuating apparatus 3 which can be operated manually cannot be moved to the safe position and thus cannot be closed either. Conversely, when the actuating apparatus 3 which can be operated manually is blocked in the safe position, the contact link 10 is reliably disconnected from the stationary contacts 6, 7. There is thus no need for any additional switching device with an isolating function or main switch characteristics.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromagnetic switching device, comprising:

an electromagnetic drive apparatus;

a moving contact element, operatable by the drive apparatus and switchable between a bridging position, adapted to connect a pair of stationary contacts, and a disconnected position, adapted to disconnect the stationary contacts;

an actuating apparatus including an actuating element adapted to interact with the moving contact element and moveable between an operating position and a safe position, wherein, in the operating position, the moving contact element is switchable by the electromagnetic drive apparatus between the bridging position and the disconnected position, and wherein, by movement of the actuating element to the safe position, the moving contact element is adapted to move from the bridging position to the disconnected position, and is adapted to be blocked in the disconnected position;

wherein the moving contact element is adapted to be blocked in the bridging position by the actuating element when the actuating element is in an on position.

2. The electromagnetic switching device as claimed in claim 1, wherein the actuating apparatus is adapted to be manually operatable, and further comprising:

an auxiliary switch, coupled to the manually operatable actuating apparatus, adapted to disconnect the electromagnetic drive apparatus from its power supply when the actuating element is in the safe position.

3. The electromagnetic switching device as claimed in claim 1, wherein the actuating apparatus is adapted to be manually operatable and wherein the electromagnetic drive apparatus, the moving contact element and the actuating element are intersected by a common axis.

4. The electromagnetic switching device as claimed in claim 1, wherein the actuating element is movable linearly relative to the moving contact element.

5. The electromagnetic switching device as claimed in claim 1, wherein the actuating apparatus is manually operatable and is mechanically coupled to a basic appliance, the basic appliance including the electromagnetic drive apparatus, the moving contact element and the stationary contacts.

6. The electromagnetic switching device as claimed in claim 5, wherein the actuating apparatus is latched to the basic appliance, which acts as a contactor.

7. The electromagnetic switching device as claimed in claim 1, wherein the actuating apparatus is operatable by way of a rotary switch.

8. The electromagnetic switching device as claimed in claim 1, wherein the actuating apparatus is adapted to be blocked in the safe position by way of a lock.

9. The electromagnetic switching device as claimed in claim 1, wherein the actuating apparatus is adapted to be manually operatable, and further comprising:

an auxiliary switch, coupled to the manually operatable actuating apparatus, adapted to disconnect the electromagnetic drive apparatus from its power supply when the actuating element is in the safe position.

10. The electromagnetic switching device as claimed in claim 1, wherein the actuating apparatus is adapted to be manually operatable and wherein the electromagnetic drive apparatus, the moving contact element and the actuating element are intersected by a common axis.

11. The electromagnetic switching device as claimed in claim 1, wherein the actuating element is movable linearly relative to the moving contact element.

12. The electromagnetic switching device as claimed in claim 1, wherein the actuating apparatus is manually operatable and is mechanically coupled to a basic appliance, the basic appliance including the electromagnetic drive apparatus, the moving contact element and the stationary contacts.

13. The electromagnetic switching device as claimed in claim 12, wherein the actuating apparatus is latched to the basic appliance, which acts as a contactor.

14. The electromagnetic switching device as claimed in claim 1, wherein the actuating apparatus is operatable by way of a rotary switch.

15. The electromagnetic switching device as claimed in claim 1, wherein the actuating apparatus is adapted to be blocked in the safe position by way of a lock.

16. An electromagnetic switching device, comprising:

a moving contact element, switchable between a bridging position, adapted to connect a pair of stationary contacts, and a disconnected position, adapted to disconnect the stationary contacts;

actuating means for moving relative to the moving contact element, and for moving between an operating position and a safe position; and means for switching the moving contact element between the bridging position and the disconnected position, wherein, by movement of the actuating means to the safe position, the moving contact element is movable from the bridging position to the disconnected position, and is blocked in the disconnected position;

wherein the moving contact element is blocked in the bridging position by the actuating means when the actuating means is in an on position.

17. The electromagnetic switching device as claimed in claim 16, wherein the actuating means is manually operatable, and further comprising:

switching means, coupled to the manually operatable actuating means, for disconnecting the means for switching from its power supply when the actuating means is in the safe position.

18. The electromagnetic switching device as claimed in claim 16, wherein the actuating means is manually operatable and wherein the means for switching, the moving contact element and the actuating means are intersected by a common axis.

19. An electromagnetic switching device, comprising:

an electromagnetic drive apparatus;

a moving contact element, operatable by the drive apparatus and switchable between a bridging position, adapted to connect a pair of stationary contacts, and a disconnected position, adapted to disconnect the stationary contacts;

an actuating apparatus including an actuating element adapted to interact with the moving contact element and moveable between an operating position and a safe position, wherein, in the operating position, the moving contact element is switchable by the electromagnetic drive apparatus between the bridging position and the disconnected position, and wherein, by movement of the actuating element to the safe position, the moving contact element is adapted to move from the bridging position to the disconnected position, and is adapted to be blocked in the disconnected position;

wherein the actuating apparatus is adapted to be manually operatable and wherein the electromagnetic drive apparatus, the moving contact element and the actuating element are intersected by a common axis.

* * * * *